US005924896A

United States Patent [19]

Arnett et al.

[11] Patent Number: 5,924,896

[45] Date of Patent: Jul. 20, 1999

[54] HIGH FREQUENCY COMMUNICATION JACK

[75] Inventors: Jaime Ray Arnett, Fishers, Ind.; Ronald Herbert Guelden, Omaha, Nebr.

[73] Assignee: Lucent Technologies Inc., Murray Hill, N.J.

[21] Appl. No.: 08/904,391

[22] Filed: Aug. 1, 1997

[51] Int. Cl.[6] ..... H01R 21/22

[52] U.S. Cl. ..... 439/676; 439/76.1; 439/751

[58] Field of Search ..... 439/676, 76.1, 439/395, 404, 405, 751, 873, 941, 82

[56] References Cited

U.S. PATENT DOCUMENTS

| | | | |
|---|---|---|---|
| D. 354,268 | 1/1995 | Siemon et al. | D13/133 |
| 3,798,587 | 3/1974 | Ellis, Jr. et al. | 439/403 |
| 4,136,628 | 1/1979 | McGonigal et al. | 29/630 R |
| 4,171,858 | 10/1979 | Knowles et al. | 439/397 |
| 4,202,593 | 5/1980 | Abernethy et al. | 439/676 |
| 4,206,964 | 6/1980 | Olsson | 439/873 |
| 4,262,985 | 4/1981 | Muehlhausen, II | 439/401 |
| 4,274,691 | 6/1981 | Abernethy et al. | 439/676 |
| 4,909,754 | 3/1990 | Paradis | 439/405 |
| 5,096,442 | 3/1992 | Arnett et al. | 439/676 |
| 5,186,647 | 2/1993 | Denkmann et al. | 439/676 |
| 5,299,956 | 4/1994 | Brownell et al. | 439/676 |
| 5,432,484 | 7/1995 | Klas et al. | 439/676 |
| 5,459,443 | 10/1995 | Mouissie | 439/620 |
| 5,492,484 | 2/1996 | Archer | 439/408 |
| 5,503,572 | 4/1996 | White et al. | 439/676 |
| 5,513,065 | 4/1996 | Caveney et al. | 439/941 |
| 5,580,270 | 12/1996 | Pantland et al. | 439/676 |
| 5,645,445 | 7/1997 | Siemon et al. | 439/723 |
| 5,700,167 | 12/1997 | Pharney et al. | 439/941 |

OTHER PUBLICATIONS

AMP, Modular Interconnection System, Cable Mounted Jacks, Part No. 557901–1 (2 pages).

*Primary Examiner*—Paula Bradley
*Assistant Examiner*—Tho D. Ta

[57] ABSTRACT

A communication jack assembly suitable for high data rate applications, includes a wire board having conductive paths that extend between a jackwire terminal region at a first portion of the board and a wire-connection terminal region at a second portion of the board. A number of spring jackwires extend through the jackwire terminal region, to connect with a communication plug when placed in the jackwire terminal region. The jackwires connect at one end to corresponding conductive paths on the wire board, and the conductive paths form a part of at least one communications signal path when the plug is connected to the jackwires. The conductive paths may be configured to compensate for crosstalk otherwise developed in a signal path once the plug is mated with the jack. A dielectric terminal housing is formed to protect the wire-connection terminal region on top of the wire board, and a cover is formed to protect the connection terminal region on the bottom of the board. The wire board is captured between the housing and the cover when the housing and cover are joined to one another.

17 Claims, 4 Drawing Sheets

HIGH FREQUENCY COMMUNICATION JACK

BACKGROUND OF THE INVENTION

1. Field of the Invention

The present invention relates to connectors for communication wires and cables, and particularly to a communication jack construction suitable for high frequency information transmission applications.

2. Discussion of the Known Art

A compact communications jack connector is disclosed in U.S. Pat. No. 5,096,442 (Mar. 17, 1992). The known connector is formed from a unitary lead frame in which eight flat, elongated conductive elements connect spring jackwire terminals at one end of the frame with corresponding wire connection terminals at the other end of the frame. The wire connection terminals are insulation displacement connectors (IDCs) of the "slotted-beam" type. For example, see U.S. Pat. No. 3,027,536 (Mar. 27, 1962); U.S. Pat. No. 3,798,587 (Mar. 19, 1974) and U.S. Pat. No. 4,826,449 (May 2, 1989).

In the mentioned '442 patent, the lead frame is placed against a bottom surface of a dielectric spring block, the jackwire terminals are wrapped around a tongue-like protrusion on the block, and the elongated conductive elements are positioned flat and parallel to one another on the block bottom surface. Individual IDC terminals of the lead frame are folded onto side surfaces of the block. Slots in the IDC terminals align with corresponding wire-receiving slots formed in the block, and a cover is placed around the block including the wrapped IDC terminals. The tongue-like protrusion of the block is received in a jack frame, and the jackwire terminals are aligned so that when a connecting plug is inserted the jack frame, the jackwire terminals connect electrically with corresponding wire leads in the plug.

A communication jack made by AMP Corporation (Part. No. 557901-1) and intended for high data rate applications includes a printed wire board, jackwires that emerge from a top surface of the board and bend sharply back over the board, and sets of wire connection terminals at the sides of the board. Two separate terminal covers are each held in place by pins which pass horizontally through openings in the terminal bases. The top surface of the wire board is left exposed between the separated terminal covers. A front end of the board slides into a jack frame, and tabs on the sides of the board snap in slots in rear side walls of the jack housing. The jack housing also has a rear bottom wall that extends over the bottom surface of the wire board.

Pending U.S. patent application Ser. No. 08/668,553 filed Jun. 21, 1996, and assigned to the assignee of the present invention, relates to a device for reducing crosstalk exhibited by certain connectors. All relevant portions of the '553 application are incorporated by reference herein. The device comprises a printed wire board having several dielectric layers. Pairs of conductor paths are formed on selected layers, and a conductor path of one pair is vertically aligned and spaced from a conductor path of another pair on an adjacent layer. A given set of vertically aligned paths acts electrically as a capacitor plate that cooperates with a horizontally adjacent set of vertically aligned paths, to compensate for or reduce crosstalk exhibited by a given connector. As far as is known, the crosstalk reduction scheme of the '553 application has not been applied in a communication jack.

U.S. Pat. No. 5,186,647 (Feb. 16, 1993) shows a high frequency electrical connector similar to the mentioned U.S. Pat. No. 5,096,442; but wherein certain pairs of the parallel conductive elements cross over one another as a means for reducing crosstalk. All relevant portions of the '647 patent are incorporated by reference herein. Other arrangements for reducing crosstalk are disclosed by U.S. Pat. No. 5,432,484 (Jul. 11, 1995); U.S. Pat. No. 5,299,956 (Apr. 5, 1994); and U.S. Pat. No. 5,580,270 (Dec. 3, 1996) all relevant portions of which are incorporated herein by reference.

It is also known to construct a terminal post with a retaining portion formed of two arcuate spring members which are separated by an opening, thus resembling a "needle eye". See, for example, U.S. Pat. No. 4,206,964 (Jun. 10, 1980). See also U.S. Pat. Des. No. 345,268 (Jan. 10, 1995) showing a telecommunications terminal clip having a slotted retaining portion.

There remains a need for a durable high frequency communication jack that will minimize or compensate for crosstalk between two or more signal paths through the jack, particularly when a communication plug, which alone may tend to introduce undesirable crosstalk, is mated with the jack. The resulting plug-jack connection should nonetheless allow for high data rate transmission in a wired network, whether local or global.

The desired jack should also be easy to manufacture in high volume, and be compliant. That is, the jack should maintain its high performance characteristics notwithstanding repeated connection with and disconnection from mating plugs, and use with plugs having different numbers of wire conductors. In particular, unused jackwire terminals should not be permanently deformed when deflected by plug bodies that carry fewer wire conductors than the number of jackwire terminals in the jack. With respect to manufacturing steps, a communication jack that uses minimal horizontal or side-wise tool movements during assembly, and relies primarily on vertical or straight up-and-down tool motion for its construction, is also desirable.

SUMMARY OF THE INVENTION

According to the invention, a communication jack assembly comprises a wire board, conductive paths on the board which paths extend between a jackwire terminal region at a first portion of the board and a wire connection terminal region at a second portion of the board, a board top surface and a board bottom surface. A number of spring jackwires extend through the jackwire terminal region, to connect with a communication plug when placed in the jackwire terminal region. The jackwires connect at one end to corresponding conductive paths on the wire board, and the conductive paths form a part of at least one communication signal path when the plug is connected with the jackwires. The conductive paths may be configured to compensate for or to reduce crosstalk otherwise developed in the communication signal path when the plug is connected with the jackwires.

An electrically insulative housing is formed to protect the wire connection terminal region at the top surface of the board. A cover is formed to protect the connection terminal region at the bottom surface of the wire board. The housing and the cover are joined by a fastening arrangement to one another with the wire board captured between them.

According to another aspect of the invention, a communication jack assembly includes a wire board having conductive paths that extend between a jackwire terminal region on a first portion of the board and a wire-connection terminal region on a second portion of the board, a board top surface and a board bottom surface. A number of spring jackwires extend downward from an equal number of first plated holes in the jackwire terminal region, the jackwires having a needle-eye portion at one end for mechanically and electrically connecting the jackwires in the first plated holes. A number of metallic terminals extend upward from an equal number of second plated holes in the wire-connection terminal region, the metallic terminals having a needle-eye portion at one end for mechanically and electrically connecting the metallic terminals in the second plated holes.

A jackwire block is fixed to the bottom surface of the wire board, the block including a jackwire mandrel constructed and arranged to seat the spring jackwires and to establish a certain minimum bend radius for each of the jackwires. A dielectric jack frame has a rear opening dimensioned to receive a portion of the wire board including the jackwires, and a rear portion of the jack frame is constructed and arranged to align the jackwires and to guide each jackwire when deflected by a plug inserted in the jack frame.

For a better understanding of the invention, reference is made to the following description taken in conjunction with the accompanying drawing, and the scope of the invention will be pointed out by the appended claims.

DETAILED DESCRIPTION OF THE INVENTION

Figure 1:
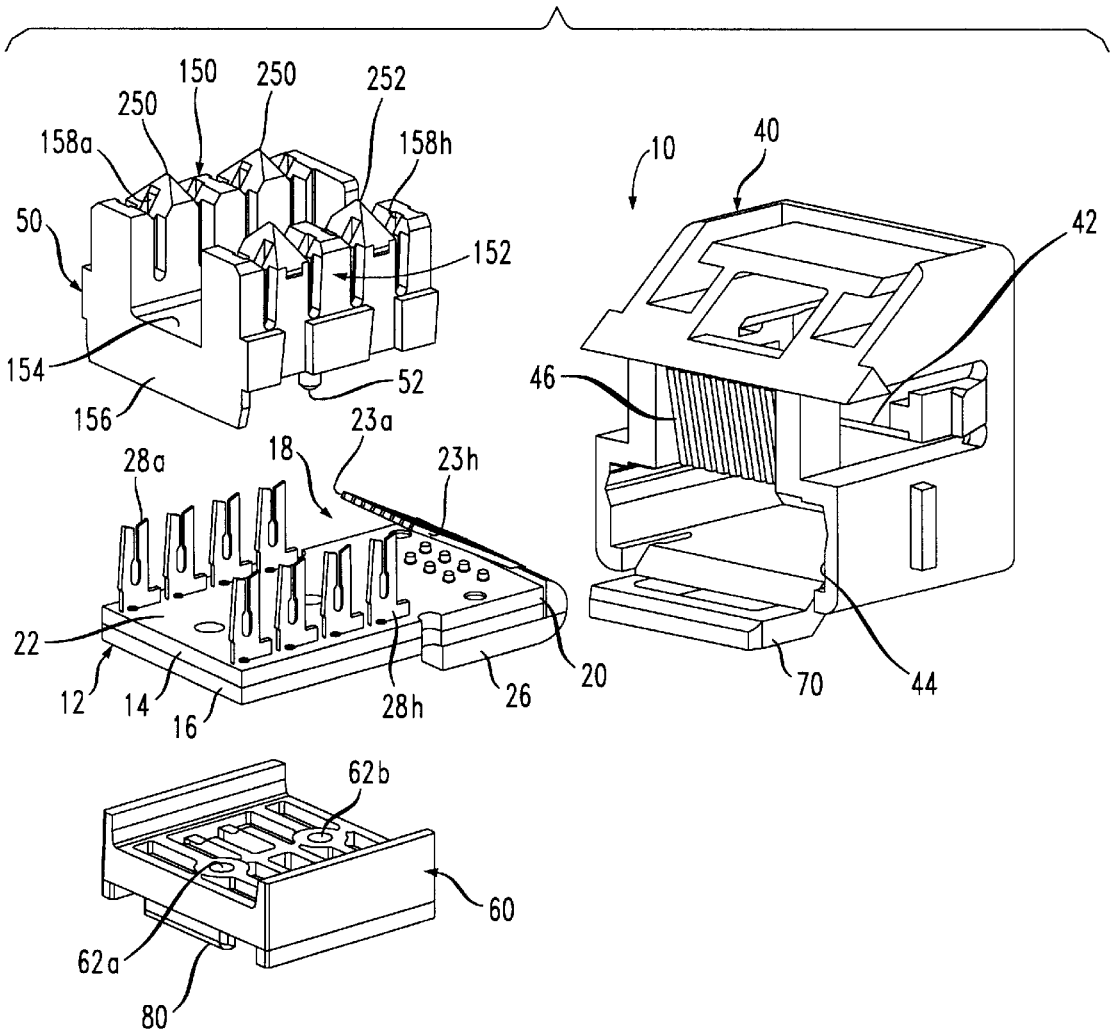
FIG. 1 is an exploded view of a high frequency communication jack assembly and a mating jack frame, according to the invention.

FIG. 1 is an exploded view of a high frequency communication jack 10 according to the invention. The jack 10 includes a printed wire board 12 which preferably is multilayered. Although two layers 14, 16 are shown in FIG. 1, the wire board 12 may comprise one layer with printed conductive paths on one or both sides, or additional layers with conductive paths on each layer, depending on the desired crosstalk reduction scheme. In FIG. 1, wire board 12 has conductive paths (see FIG. 7) on the layers 14, 16 which paths extend between a jackwire terminal region 18 near a front edge 20 of the board 12, and a wire connection terminal region 22 at a rear portion of the board.

A number, for example, eight spring jackwires 23*a* to 23*h* extend from the front of the board 12 through the jackwire terminal region 18, at an acute angle relative to the top surface of the wire board 12 to connect with a communication plug (not shown) when the plug is placed in the jackwire terminal region 18. The jackwires 23*a*–23*h* connect at their bottom ends to corresponding conductive paths of the wire board 12, so that the conductive paths form a part of one or more communication signal paths when the communication plug is connected with the jackwires. Typically, each communication signal path will be comprised of a different pair of conductive paths on the wire board 12. In the disclosed embodiment, up to four communication signal paths can be supported by the eight jackwires 23*a*–23*h*, with a corresponding number of conductive paths on the board.

Preferably, the conductive paths associated with the wire board 12 are configured individually or in combination with other discrete components (not shown) such as resistors, capacitors and inductors, to compensate for or to reduce crosstalk otherwise developed in a communication signal path when the plug is connected with the jackwires.

The bottom ends of the jackwires 23*a*–23*h* are inserted in plated openings in the bottom surface of the wire board to connect with the conductive paths, and the jackwires wrap around a curvilinear forward end of a jackwire block 26. Details of the jackwire block 26 are given in connection with FIGS. 2 and 3. Preferably, the bottom ends of the jackwires 23*a*–23*h* have a "needle eye" construction that allows the ends to be pushed into the plated openings underneath the board 12. The openings have a diameter slightly less than that of the bottom ends of the jackwires. A reliable electrical connection is established between the jackwires and the conductive paths without a need for soldering. The "needle eye" configuration is described below in detail with respect to connector terminals 28*a* to 28*h* of the present jack 10.

Insulation displacement connector (IDC) terminals 28*a* to 28*h* are mounted at both rear sides of the wire board 12 as shown in FIG. 1. Each of the terminals 28*a*–28*h* connects to a corresponding conductive path associated with a different one of the spring jackwires 23*a*–23*h*. Details of the IDC terminals 28*a*–28*h* are given in connection with FIG. 7. A pair of terminal housing mounting holes are formed in the wire board 12, along a center line between the rear sides of the board.

A jack frame 40 (FIG. 1) for the present jack 10 may be a similar to one disclosed in co-pending U.S. patent application Ser. No. 08/866,796 filed May 30, 1997, and assigned to the assignee of the present invention. All relevant portions of the '796 application are incorporated by reference herein. Alternatively, a jack frame similar to the one disclosed in the mentioned U.S. Pat. No. 5,096,442 may also be used for the jack frame 40 in FIG. 1. The jack frame 40 has a front opening 42 which faces toward the right rear in FIG. 1. The frame 40 also has a rear opening or cavity 44 that is dimensioned to receive the forward edge 20 of the wire board 12 including the jackwires 23*a*–23*h*. A rear portion 46 of the jack frame is formed with a number (e.g., 8) of vertical slots which receive corresponding ones of the jackwires 23*a*–23*h* and guide each jackwire to deflect when a plug (not shown) is placed through the frame front opening 42 into the jackwire terminal region 18 over the wire board 12. Wire conductors carried by the inserted plug thus establish electrical contact with corresponding ones of the jackwires 23*a*–23*h*.

Figure 5:
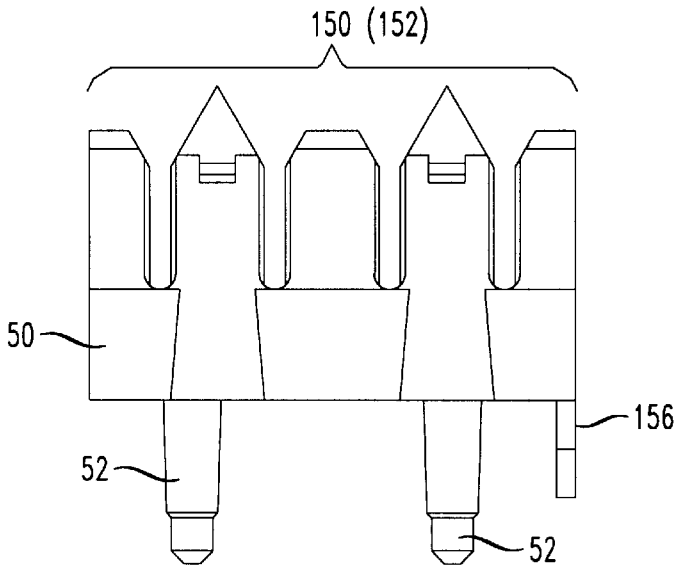
FIG. 5 is an enlarged side view of a terminal housing of the jack as seen from the rear left side in FIG. 1.
Figure 6:
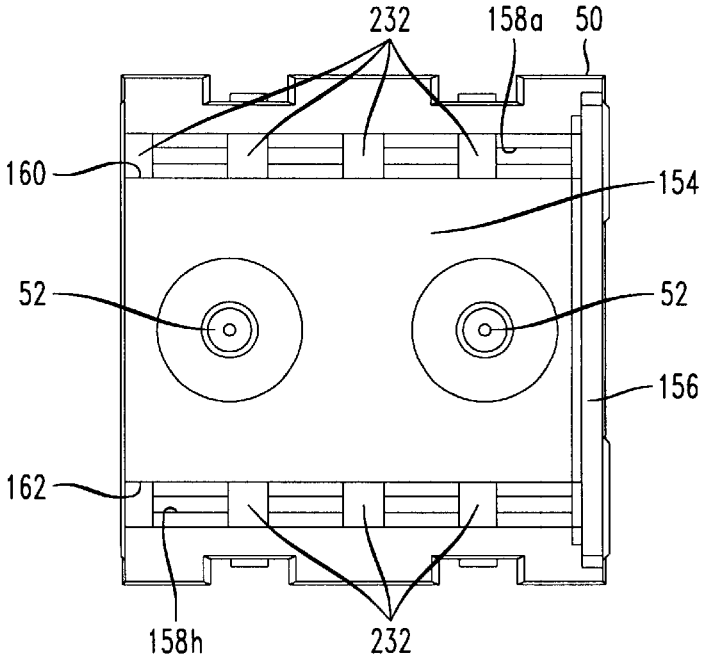
FIG. 6 is a bottom plan view of the housing in FIG. 5.

An electrically insulative or dielectric terminal housing 50, also in FIG. 1, is formed to protect and to permit wire lead access to the wire connection terminal region 22 on top of the wire board 12. Details of the housing 50 are set out below in connection with FIGS. 5 to 7. The housing 50 may be formed of a plastics material that meets all applicable standards with respect to electrical insulation and flammability. Such plastics materials include but are not limited to polycarbonate, ABS, and blends thereof. The housing 50 has a pair of fastening or mounting posts 52 that project from a bottom surface of the housing, as shown in FIGS. 5 and 6. When the housing 50 is aligned with the IDC terminals 28*a*–28*h* on the wire board 12 and lowered to surround the terminals, the fastening posts 52 align with the rear openings in the board 12 and pass through them to project from below the board.

A cover 60 is made from a material that may be the same or similar to that of the housing 50 and the jack frame 40. Cover 60 is formed to protect the bottom of the board 12 at the connection terminal region 22. The cover 60 has a pair of openings 62*a*, 62*b* formed along a center line between sides of the cover 60, to align with tips of the housing fastening posts 52 that project below the wire board 12. The wire board 12 is sandwiched or captured between the housing 50 and the cover 60, and the tips of the mounting posts 52 are preferably joined to the body of the cover 60 by, for example, an ultrasonic welding probe inserted into the cover openings 62*a*, 62*b* from below the cover 60 in FIG. 1. The tips of the mounting posts 52 and the surrounding cover body melt and fuse with one another to form solid joints when cooled. With the wire board 12 thus captured between the housing 50 and the cover 60, substantially the entire wire connection terminal region 22 of the board 12 is protectively enclosed.

The jack frame 40 has a latch 70 protruding below the rear opening 44 in FIG. 1. The cover 60 has a pair of shoulders 80 adjacent the front and the back edges of the cover 60. Once the housing 50 is joined to the cover 60 with the wire board 12 captured between them, the front edge 20 of the wire board 12 is inserted in the rear cavity 44 in the jack frame 40, until the frame latch 70 snaps over and onto an adjacent shoulder 80 on the bottom of cover 60.

Figure 2:
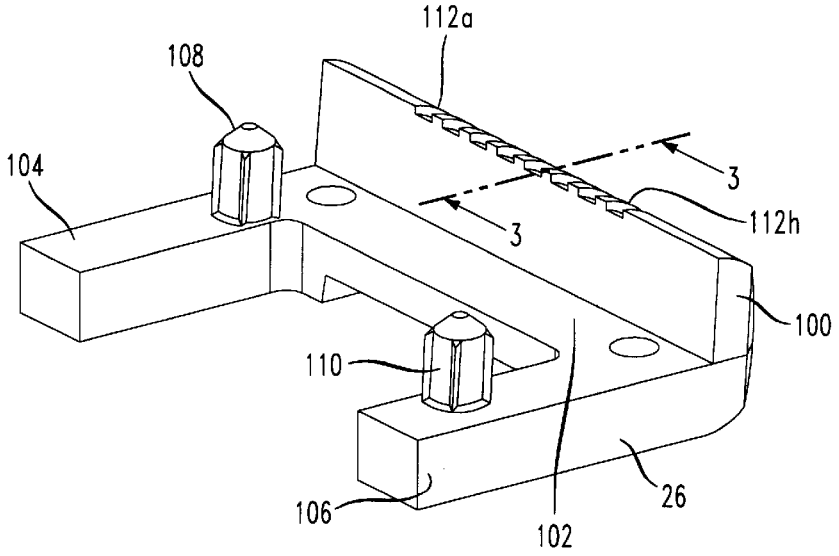
FIG. 2 is an enlarged perspective view of a spring jackwire block in the jack of FIG. 1.

FIG. 2 is a perspective, enlarged view of the jackwire block 26 in the jack 10 of FIG. 1. The jackwire block 26 is made of a material that may be the same or similar to that used to form the jack frame 40, housing 50 and cover 60 in FIG. 1. The block 26 has a front jackwire mandrel 100 and a frame support 102 for the mandrel 100. A post 108 projects upward from leg 104, and another post 110 projects upward from leg 106. The posts 108, 110 have vertical ribs to enable them to be press fit from beneath the wire board 12 into corresponding openings in the front portion of the board (see FIG. 1).

Figure 3:
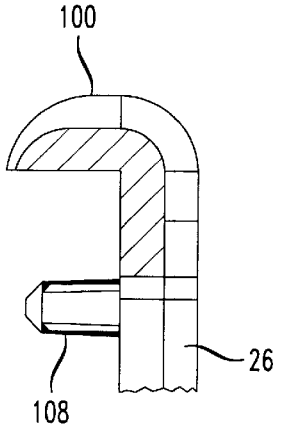
FIG. 3 is a side view, partly in section, of the jackwire block in FIG. 2 as taken along line 3—3 in FIG. 2.
Figure 4:
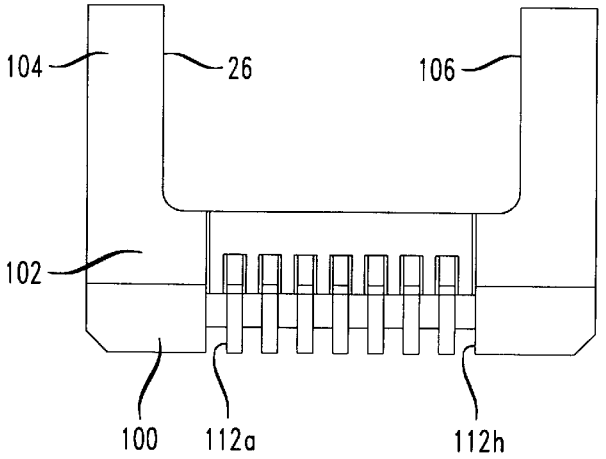
FIG. 4 is a plan view of the jackwire block as seen from the bottom in FIG. 2.

FIG. 3 is a side view of the jackwire block 26 in FIG. 2, partly in section and taken along line 3—3 in FIG. 2. FIG. 4 is a view of the block 26 as seen from below in FIG. 2.

Mandrel 100 defines a number (e.g., 8) of vertical slots 112*a* to 112*h* in its front edge for seating and guiding corresponding ones of the jackwires 23*a*–23*h* in FIG. 1. The jackwires are wrapped around an inner contour of the mandrel 100 at the base of each slot, as shown in FIG. 3. Specifically, first ends of the jackwires are inserted in plated holes in the bottom of the wire board 12, which ends are visible protruding from the top of the board in FIG. 1. In the present embodiment, the jackwire holes in the board 12 are arrayed in two rows of four holes each, and the holes are staggered to allow the jackwires to run parallel to one another with a uniform gap between adjacent jackwires. A typical center-to-center slot spacing on the mandrel 100 is about 0.040 inches.

As shown in FIG. 1, the jackwire block 26 is fixed on the bottom surface of the wire board 12 so that the back of the mandrel 100 is fitted against the front edge 20 of the board. The jackwires 23*a*–23*h* are routed parallel to one another underneath the board and are guided through corresponding mandrel slots 112*a*–112*h*, and the jackwires are wrapped over the front of the mandrel within the slots 112*a*–112*h*. As shown in FIG. 3, mandrel 100 provides a bend radius of about 0.040 inches to the jackwires as they emerge from beneath the wire board 12, and a second bend radius of about 0.050 inches where the jackwires begin to angle back over the wire board 12. Because the mandrel 100 ensures that the jackwires 23*a*–23*h* will not have less than a determined bend radius around the front edge 20 of the wire board any tendency of a jackwire to become permanently deformed i fits free end is over-deflected inside the jack frame 40, is substantially reduced.

FIG. 5 is a side view of the terminal housing 50 of the present jack 10. Housing 50 is preferably molded as a single piece which defines two banks of IDC terminal wire guide posts 150, 152 at corresponding sides of the housing. The two banks of wire guide posts 150, 152 are joined by an integral base wall 154 shown in FIGS. 1 and 6. The housing fastening posts 52 project from the bottom of the base wall 154, as shown in FIG. 6. The guide posts and the base wall together act to protect the top surface of the wire board 12 at the wire connection terminal region 22 (see FIG. 1).

The housing 50 also has a rear apron 156 that protects the rear edge of the wire board 12 when the board is captured between the housing 50 and the cover 60. Wire connecting portions of the IDC terminals 28*a*–28*h* in FIG. 1, are received in corresponding terminal slots 158*a* to 158*h* that open in rows along the bases of a pair of channels 160, 162 grooved underneath the housing base wall 154. The channels 160, 162 accommodate base portions of the IDC terminals just above the wire board 12, as illustrated in FIG. 7.

Figure 7:
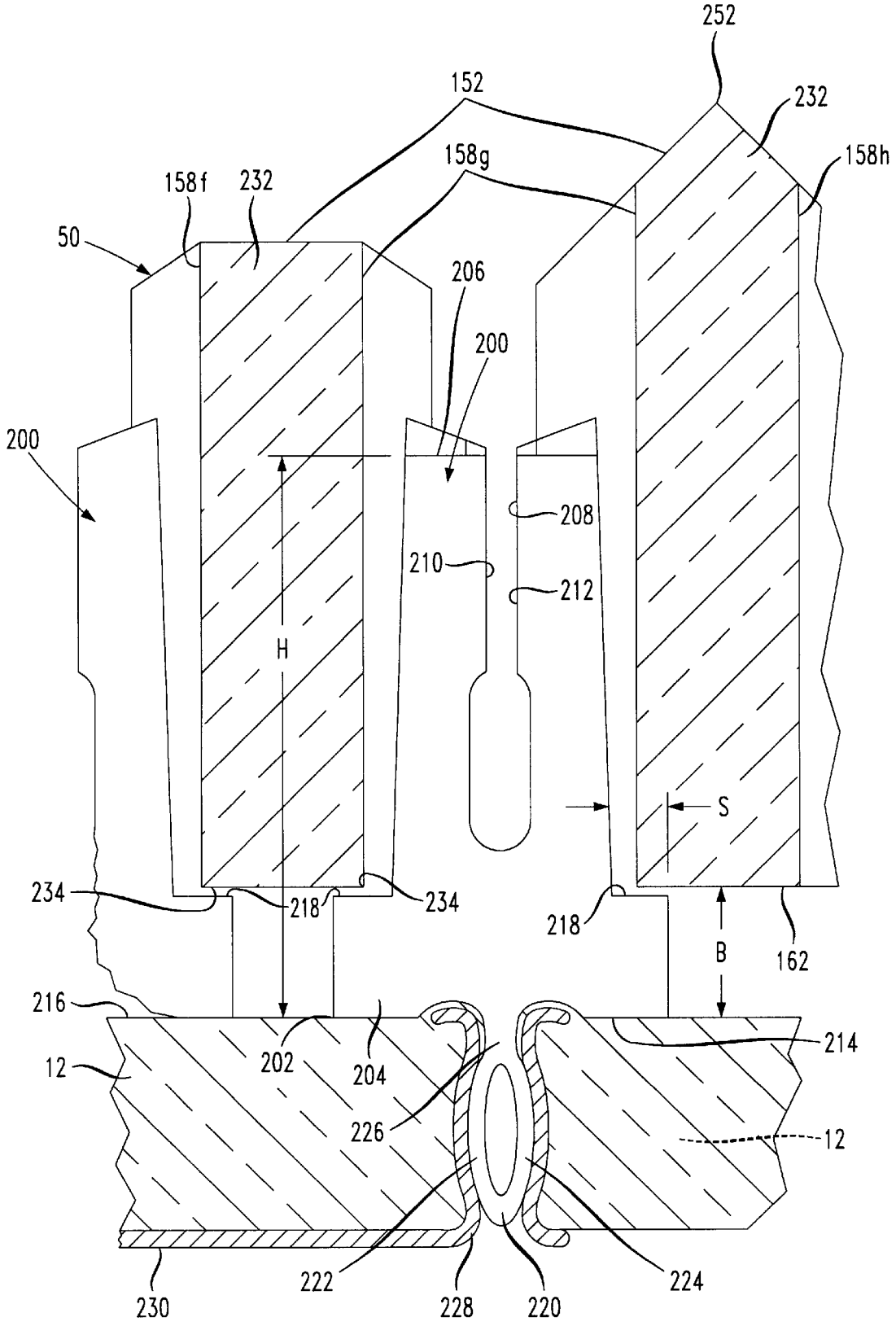
FIG. 7 is an enlarged side elevation view of a connector terminal in the jack of FIG. 1 with the terminal housing in place.

FIG. 7 is an elevational view of an IDC terminal 200 for use in the present communications jack 10. The terminal 200 preferably has the following features detailed in connection with FIG. 7. Terminal 200 may be formed of a metallic material such as, for example, a copper alloy having a thickness of about 0.015 inches, and with a bright solder finish of between 0.1 and 0.3 mils thick. The height H of terminal 200 is preferably about 0.230 inches between a bottom edge 202 of a mounting base portion 204, and an upper inside sharp ledge 206 on both sides of an insulated wire receiving groove 208 in the terminal 200. As is known generally in the art, when an insulated wire conductor is held at the top of an IDC terminal and is pushed down within a terminal groove, opposed ledges such as ledges 206 will cut through the insulation on the conductor and establish electrical contact via side surfaces 210, 212 between the conductor and the IDC terminal 200. A typical width of the groove 208 is about 0.012 inches.

The mounting base portion 204 has a bottom edge 214 portions of which align flush with a top surface 216 of the wire board 12 on which the IDC terminal 200 is mounted. A top part of the base portion 204 defines a shoulder 218 that protrudes a certain distance S from the wire receiving portion of the terminal 200. The shoulder 218 is at a determined height B above the bottom edge 214 of the base portion 204. Typical dimensions are S=about 0.025 inches and B=about 0.053 inches.

The IDC terminal 200 also has a wire board mounting part 220 with a generally "needle-eye" appearance. The board mounting part 220 comprises opposed arcuate sections 222, 224 joined to the bottom edge 214 of the terminal by a common stem 226. The arcuate sections 222, 224 have an inner radius of typically about 0.083 inches and an outer radius of typically about 0.094 inches. The height of the "eye" opening defined between the sections 222, 224 is typically about 0.056 inches and the width of the opening about 0.014 inches. The width of the metal strips forming the sections 222, 224 is typically about 0.011 inches. The entire IDC terminal 200 including its base portion 204 and board mounting part 220 are preferably stamped from a single sheet of metallic material.

An important feature of the IDC terminal 200 is that its wire board mounting part 220 can establish reliable electrical contact with a plated opening 228 in the wire board 12, if the diameter of the opening 228 is slightly less than the overall width (e.g., 0.035 inches) of the "needle-eye" mounting part 220. That is, the mounting part 220 can be urged in the direction of the axis of the opening 228 to mount the terminal on the board 12, and the arcuate sections 222, 224 are urged resiliently toward one another to maintain positive electrical contact with the plated wall of the board opening 228. A conductive path 230 on the board 12 which connects with the plating of opening 228, is thus electrically connected to the terminal 200. It has been discovered that no further bonding such as solder is necessary to maintain electrical contact between the terminal 200 and the conductive plating of the wire board opening 228.

Another desirable feature of the IDC terminal 200 in FIG. 7, is that it is held securely in place on the wire board 12 via a part of the terminal housing body that abuts the shoulder 218 when the housing 50 is joined to the cover 60 through the wire board 12. That is, a wire conductor can be repeatedly inserted and withdrawn from the groove 208 in the terminal 200 without substantially dislocating the terminal, and without causing mounting part 220 to lose contact with a conductive path that leads to the terminal mounting hole. That is, the terminal 200 is captured between the wire board 12 and the body of the connector housing 50 once the terminal is inserted in a corresponding one of slots 158*a*–158*h* in the housing, and the housing is joined to the cover 60 with the wire board 12 sandwiched between them.

Specifically, as shown in FIGS. 6 and 7, the terminal slots 158*a*–158*h* opening at the bases of the channels 160, 162 in the housing base wall 154 (see FIG. 6), are separated by partitions 232 formed in the body of the terminal housing 50. Each partition 232 separates adjacent ones of the terminal wire guide posts 150, 152 on the housing 50. The terminal slots 158*a*–158*h* are only sufficiently wide to receive the IDC terminals 200 down to the top of the terminal base shoulders 218. Bottom corners 234 of the partitions 232 are positioned in confronting relation to the terminal shoulders 218 when the terminals are mounted on the wire board 12 as in FIG. 7. Thus, once a wire is pushed down in the receiving groove 208 of the terminal 200, and the wire is later pulled upward in FIG. 7 to be disconnected from the terminal, vertical displacement of the terminal 200 is stopped by the bottom corners 234 of the partitions 232. It will be appreciated that some limited vertical movement of the terminal 200 can be tolerated since its board mounting part 220 is not soldered in the board opening 228 and sliding electrical contact with the plated wall of the opening 228 can be maintained.

Adjacent ones of the terminal wire guide posts 150, 152 on housing 50 form sharply pointed or pyramidal top ends 250, 252. See FIGS. 1 and 7. The purpose of the pointed ends 250, 252 on the guide posts is to assist in separating each lead of a tightly twisted, unshielded lead pair (not shown) when the lead pair is pressed against one of the ends 250, 252. Each lead of the pair can then be dragged down along a corresponding inclined surface at the top of the post, and between knife edges of an IDC terminal groove which edges are exposed inside a vertical slot formed in each of the guide posts. The present construction of the housing 50 is therefore well suited to high data rate applications where tightly twisted, unshielded lead pairs are often encountered.

The present high frequency communication jack 10 thus comprises a spring jackwire block assembly including a wire board 12 having one or more layers, and conductive metallic paths or traces on the layers arranged to reduce or to compensate for crosstalk otherwise developed when a communication plug is mated with the jack. The wire board with the jackwire block 26 is captured between a dielectric housing 50 and a cover 60 that cooperate to insulate the signal paths for insulated wires that can be pressed into grooves in the IDC terminals 200 on the wire board 12. The housing 50 has terminal wire guide posts defining pointed surfaces between each pair of IDC terminals, to assist in separation of wires of a tightly twisted wire pair, and insertion of each wire of the pair in a corresponding terminal receiving groove.

The wire board 12, jackwire block 26, jackwires 23*a*–23*h* and IDC terminals 200 define a spring block assembly. The jackwires are electrically connected to the terminals 200 by conductive paths or metallic traces on the wire board 12. The jackwire block 26 includes a mandrel 100 around which the jackwires 23*a*–23*h* are wrapped in the region of the wire board 12.

The jackwires and the IDC terminals are operatively mounted the wire board without the need for solder. The IDC terminals and jackwires have compliant "needle-eye" mounting parts that enhance their electrical connection with conductive paths on the wire board. Further, the housing 50 when joined to the cover 60 engages shoulders 218 of the IDC terminals 200 and secures said terminals to the wire board.

The low-profile IDC terminal 200 disclosed herein is suitable for mounting on a printed wire board. The terminal 200 includes at least one shoulder 218 that not only assists in the insertion of the terminal into the wire board 12, but also cooperates with a part of the housing 50 to keep the terminal in place on the wire board when, for example, a wire is withdrawn out of the terminal. Although wires are not usually pulled out from IDC terminals, rearrangements are not uncommon. The mentioned "needle-eye" structure for the mounting part of the terminal 200 is a compliant structure that may be slightly larger than a plated wire board hole in which it is inserted. Because the terminal shoulder 218 cooperates with part of the housing 50 to hold the terminal in place, the terminal need not be soldered on the wire board.

While the foregoing description represents preferred embodiments of the invention, it will be obvious to those skilled in the art that various changes and modifications may be made, without departing from the true spirit and scope of the invention. Such modifications include, but are not limited to, the use of discrete components on the wire board 12 to reduce crosstalk, and the use of metallic terminal strips (e.g., "110" type connectors) preloaded into a dielectric housing prior to installation on the wire board.

Further, the fastening arrangement between the terminal housing 50 and cover 60 is shown in the drawing as comprising at least one fastening post projecting from beneath the housing, and an opening in the cover that surrounds the tip of the post. Equivalent arrangements are also within the scope of the invention; for example, an arrangement wherein at least one fastening post projects from the cover, and a tip of the post is surrounded by an opening in the housing base wall to be fused to the wall.

What we claim is:

1. A communication jack assembly comprising:

a wire board having conductive paths that extend between a jackwire terminal region at a first portion of the board and a wire-connection terminal region at a second portion of the board, a board top surface, a board bottom surface, and a front edge;

a number of spring jackwires each connected at one end to a corresponding conductive path on said wire board, said jackwires extending through the jackwire terminal region of the board to connect with a communication plug when said plug is placed in the jackwire terminal region of the wire board;

an electrically insulative terminal housing formed to protect the wire-connection terminal region on the top surface of the wire board, said terminal housing comprising terminal wire guide posts and a bade wall that joins the guide posts;

a cover formed to protect the wire-connection terminal region at the bottom surface of the wire board;

a fastening arrangement that joins the terminal housing and the cover to one another so that the wire board is captured between the housing and the cover when joined by the fastening arrangement;

wherein the one end of each of said spring jackwires is inserted in a corresponding opening in the bottom surface of the wire board, and including a jackwire block fixed at said bottom surface, said jackwire block comprising a jackwire mandrel constructed and arranged to fit against the front edge of the wire board, to seat the spring jackwires and to establish a certain bend radius for each of the jackwires;

wherein the jackwires are routed parallel to one another near the bottom surface of the wire board, and wrap over said mandrel with said certain bend radius around a front edge of the wire board to extend at an acute angle relative to the top surface of the wire board.

2. A communication jack assembly according to claim 1, including a jack frame having a rear opening dimensioned to receive a portion of said wire board including the jackwires, wherein a rear portion of the jack frame is constructed and arranged to align the jackwires and to guide each jackwire when deflected by a plug inserted in the jack frame.

3. A communication jack assembly according to claim 1, wherein ends of the spring jackwires that connect to the conductive paths on the wire board are comprised of two opposed arcuate sections that are dimensioned for operative insertion in a jackwire terminal hole in the wire board.

4. A communication jack assembly according to claim 1, wherein said terminal housing defines two banks of terminal wire guide posts at corresponding sides of the housing, and the base wall of the terminal housing joints said banks such that the guide posts and the base wall together protect the top surface of the wire board at the wire connection terminal region of the board.

5. A communication jack assembly according to claim 1, including a number of insulation displacement connector (IDC) terminals mounted on the top surface of the wire board in the wire connection terminal region, and the IDC terminals are electrically connected to corresponding conductive paths on the wire board.

6. A communication jack assembly according to claim 5, wherein the terminal housing has terminal slots that open in rows beneath the housing to receive corresponding ones of the IDC terminals, and the housing forms partitions that separate said terminal slots from one another.

7. A communication jack assembly according to claim 6, wherein said terminal wire guide posts surround corresponding ones of the IDC terminals, and said partitions separate the terminal wire guide posts from one another.

8. A communication jack assembly according to claim 7, wherein adjacent ones of the terminal wire guide posts form a pointed top end to separate leads of a twisted wire lead pair.

9. A communication jack assembly according to claim 8, wherein the pointed top end is pyramidal in shape.

10. A communication jack assembly according to claim 6, wherein at least one of the IDC terminals is comprised of a mounting base portion having a bottom edge and a wire receiving portion projecting above the mounting base portion to connect electrically with a wire lead, a top part of the base portion defines a shoulder that protrudes a certain distance from the wire receiving portion, and the partitions in the terminal housing form bottom corners located to confront the shoulder on the base portion of the IDC terminal while the terminal slots in said housing are wide enough to accommodate the wire receiving portion of the terminal.

11. A communication jack assembly according to claim 10, wherein said at least one IDC terminal includes a wire board mounting part comprised of two opposed arcuate sections joined at one end to the bottom edge of the mounting base portion, and wherein the arcuate sections are dimensioned for operative insertion in an IDC terminal mounting hole in the wire board.

12. A communication jack assembly according to claim 1, wherein said jackwire mandrel has a number of vertical slots each for seating a different one of said jackwires.

13. A communication jack assembly according to claim 12, wherein said jackwire block includes a frame that supports the jackwire mandrel, and said frame has at least one mounting post formed to engage a jackwire block mounting hole in the wire board.

14. A communication jack assembly, comprising:

a wire board having conductive paths that extend between a jackwire terminal region on a first portion of the board and a wire-connection terminal region on a second portion of the board, a board top surface, a board bottom surfaces, and a front edge;

a number of spring jackwires that extend downward from the board bottom surface from an equal number of first corresponding holes in the jackwire terminal region of the wire board;

a number of metallic terminals that extend upward from the board top surface from an equal number of second corresponding holes in the wire-connection terminal region of the wire board;

wherein either of the spring jackwires or the metallic terminals have needle-eye portions at one end thereof for engaging the corresponding holes in the wire board;

a jackwire block fixed at the bottom surface of the wire board, said jackwire block comprising a jackwire mandrel constructed and arranged to fit against the front edge of the wire board, to seat the spring jackwires and to establish a certain bend radius for each of the jackwires;

wherein the jackwires are routed parallel to one another near the bottom surface of the wire board, and wrap over said mandrel with said certain bend radius around the front edge of the wire board to extend at an acute angle relative to the top surface of the wire board; and a dielectric jack frame having a rear opening dimensioned to receive a portion of said wire board including the jackwires, wherein a rear portion of the jack frame is constructed and arranged to align the jackwires and to guide each jackwire when deflected by a plug inserted in the jack frame.

15. A communication jack assembly according to claim 14, wherein said metallic terminals comprise insulation displacement connector (IDC) terminals mounted on the top surface of the wire board in the wire connection terminal region, and the IDC terminals are electrically connected to corresponding conductive paths on the wire board.

16. A communication jack assembly according to claim 14, wherein said jackwire mandrel has a number of vertical slots each for seating a different one of said jackwires.

17. A communication jack assembly according to claim 16, wherein said jackwire block includes a frame on the bottom surface of the wire board that supports the jackwire mandrel, and said frame has at least one mounting post formed to engage a jackwire block mounting hole in the wire board.

* * * * *